US006213113B1

(12) United States Patent
Groover et al.

(10) Patent No.: US 6,213,113 B1
(45) Date of Patent: Apr. 10, 2001

(54) BOWSTRING DRAW MECHANISM

(76) Inventors: Leona Groover; Michael Groover, both of P.O. Box 1116, Keystone Heights, FL (US) 32656

( * ) Notice: Subject to any disclaimer, the term of this patent is extended or adjusted under 35 U.S.C. 154(b) by 0 days.

(21) Appl. No.: 09/636,186

(22) Filed: Aug. 10, 2000

(51) Int. Cl.[7] ..... F41B 5/18; F41B 5/16
(52) U.S. Cl. ..... 124/86; 124/35.2
(58) Field of Search ..... 124/1, 23.1, 25.6, 124/86, 88

(56) References Cited

U.S. PATENT DOCUMENTS

| | | | | |
|---|---|---|---|---|
| 3,952,720 | | 4/1976 | Wilson | 124/35.2 |
| 4,308,851 | | 1/1982 | Kaine, Jr. et al. | 124/35.2 |
| 4,665,886 | | 5/1987 | Barlow | 124/35.2 |
| 4,787,361 | | 11/1988 | Vyprachticky | 124/88 |
| 4,957,093 | | 9/1990 | Hamlett | 124/24.1 |
| 4,969,448 | | 11/1990 | Beyer | 124/35.2 |
| 5,000,154 | | 3/1991 | Slayton | 124/23.1 |
| 5,065,730 | | 11/1991 | Kluver | 124/35.2 |
| 5,078,116 | | 1/1992 | Peck | 124/35.2 |
| 5,203,314 | * | 4/1993 | Green | 124/35.2 |
| 5,222,473 | * | 6/1993 | Lint | 124/86 |
| 5,243,956 | * | 9/1993 | Luehring | 124/86 |
| 5,243,957 | | 9/1993 | Neilson | 124/88 |
| 5,445,139 | * | 8/1995 | Bybee | 124/23.1 |
| 5,464,002 | | 11/1995 | Lavoie et al. | 124/86 |
| 5,555,874 | | 9/1996 | Savage | 124/1 |
| 5,845,628 | | 12/1998 | Pellerite | 124/35.2 |
| 5,931,146 | * | 8/1999 | Schrader et al. | 124/23.1 |
| 6,012,440 | * | 1/2000 | Grindle | 124/86 |

* cited by examiner

*Primary Examiner*—John A. Ricci
(74) *Attorney, Agent, or Firm*—Saliwanchik, Lloyd & Saliwanchik

(57) ABSTRACT

The present invention describes a mechanism for assisting an archer in drawing back a bowstring. The bowstring draw assist mechanism includes two interactive components. The first component, a support frame in the form of cable guards and a cross bar, is affixed to the bow, and the second component, a gauntlet, is worn by an archer. The first and second components engage one another and utilize compressed gas to pressurize a cylinder, assisting an archer in drawing the bowstring.

19 Claims, 5 Drawing Sheets

BOWSTRING DRAW MECHANISM

FIELD OF THE INVENTION

The present invention relates generally to an archery device and, in particular, to a mechanism for assisting an archer in drawing back a bowstring.

DESCRIPTION OF THE RELATED ART

Archery has continued to increase in popularity, both as a sport and as recreational activity, for target shooting and hunting. One of the most popular types of bows in current use is the compound bow. Compound bows employ a relatively complex cable and pulley arrangement in which the geometry of the system is quite critical. As a result of the pulley arrangement, the maximum draw of the bowstring is exerted only during the first ½ or ⅔ of its displacement. As the bowstring is drawn back towards its maximum deflection, a sudden reduction in draw pressure is experienced (as much as 80%), whereafter the archer may easily draw the bowstring back through the remaining draw distance.

However, in spite of the reduction in draw pressure, there is still a required, substantial, initial draw pressure which, even after shooting just a few times, can result in muscle fatigue and cramping of the archer's arm and shoulder, often leading to inaccuracy. Additionally, persons of lesser strength, or with chronic or debilitating shoulder injuries, may be unable to achieve even this initial draw pressure.

As a result, there are a number of devices which purport to assist the archer in drawing back the bowstring. One class of such devices is the draw and release mechanism, as illustrated in U.S. Pat. Nos. 3,952,720; 4,308,851; 4,665,886; 4,969,448; 5,078,116; and 5,845,286, the disclosures of which are incorporated herein by reference. This class includes devices which are hand-held or strapped to the wrist and have a trigger which permits the archer to release the bowstring. While this class of devices assists the archer in securely gripping the bowstring and smoothly releasing it, the devices do not provide any assistance in drawing back the bowstring.

Another class of devices includes the pre-cocking mechanisms, as illustrated in U.S. Pat. Nos. 5,000,154 and 5,065,730, the disclosures of which are incorporated herein by reference. This type of pre-cocking mechanism permits the bowstring to be drawn back and held in position prior to the knocking of an arrow. While these devices will hold the bowstring in a drawn position, they do not provide any assistance in the drawing back of the bowstring.

Accordingly, there is a need in the art for a device which assists in the drawing back of the bowstring and improves an archer's accuracy by decreasing muscle fatigue resulting from drawing back the bowstring. There is also a need in the art for a device which would open the sport of archery to a greater audience by decreasing the physical demands of the sport.

BRIEF SUMMARY OF THE INVENTION

The present invention describes a mechanism for assisting an archer in drawing back a bowstring. The bowstring draw assist mechanism preferably includes two interactive components. The first component is a support frame affixed to the bow, and the second component is a gauntlet worn by the archer.

More specifically, the support frame is removably affixed to the bow, providing a stable point to which the gauntlet engages. The support frame comprises an upper and lower cable guard, where the upper and lower cable guards are affixed to the bow's upper and lower extensions forming an offset plane parallel to the bow plane, thereby positioning the cables an offset distance from the bow plane. A cross bar comprising a push-head is perpendicularly affixed to the ends of the upper and lower cable guards. The push-head is positioned substantially planar to the firing plane.

The gauntlet is worn on the forearm of the archer, comprising a forearm sleeve and a glove. The forearm sleeve is securely attached to the glove. The forearm sleeve further comprises a cylinder pocket positioned along the exterior surface and substantially traverses the longitudinal length of the forearm sleeve. The cylinder pocket is situated such that a compressed gas actuated cylinder can be secured into the cylinder pocket. The gauntlet is secured about the archer's forearm by inserting the archer's hand into the glove and securing the forearm sleeve about the archer's forearm with the straps.

The compressed gas actuated cylinder comprises a rod with a piston fixed to one end and a rod-head fixed to the opposite end. The piston and rod are slidably fitted into the cylinder. The cylinder comprises an air inlet for connection to a compressed gas delivery system.

The compressed gas delivery system comprises a compressed gas tank fitted with an adjustable regulator. The delivery system further comprises a valve and switch, whereby the switch opens the valve thereby pressurizing the cylinder. The delivery system is attached to the cylinder at the air inlet with an appropriately rated air hose and connector.

In operation, an archer grips the bow, while simultaneously nocking an arrow and positioning the rod-head into the push-head. The archer pulls back on the bowstring and depresses the switch opening the valve. The compressed gas pressurizes the cylinder, extending the rod and pushing the rod-head into the push-head. When the bowstring is in the fully extended position, the switch is released, thereby closing the valve. Upon release of the arrow, the cylinder is vented, retracting the rod.

Therefore, it is an object of the present invention to assist in the drawing back of the bowstring and to improve an archer's accuracy, by decreasing muscle fatigue resulting from drawing back the bowstring. Further, an objective of the present invention is to open the sport of archery to a greater audience by decreasing the physical demands of the sport.

These and other objects, features and advantages of the present invention will be more readily understood with reference to the following detailed description, read in conjunction with the accompanying drawing figures.

All patents, patent applications and publications referred to or cited herein, or from which a claim for benefit of priority has been made, are incorporated by reference in their entirety to the extent they are not inconsistent with the explicit teachings of this specification.

DETAILED DISCLOSURE OF THE INVENTION

As shown in FIGS. 1–14, the bowstring draw assist mechanism of the present invention includes two interactive components. The first component, a support frame 19, is affixed to the bow 10; and the second component, a gauntlet 39, is worn by the archer.

Figure 1:
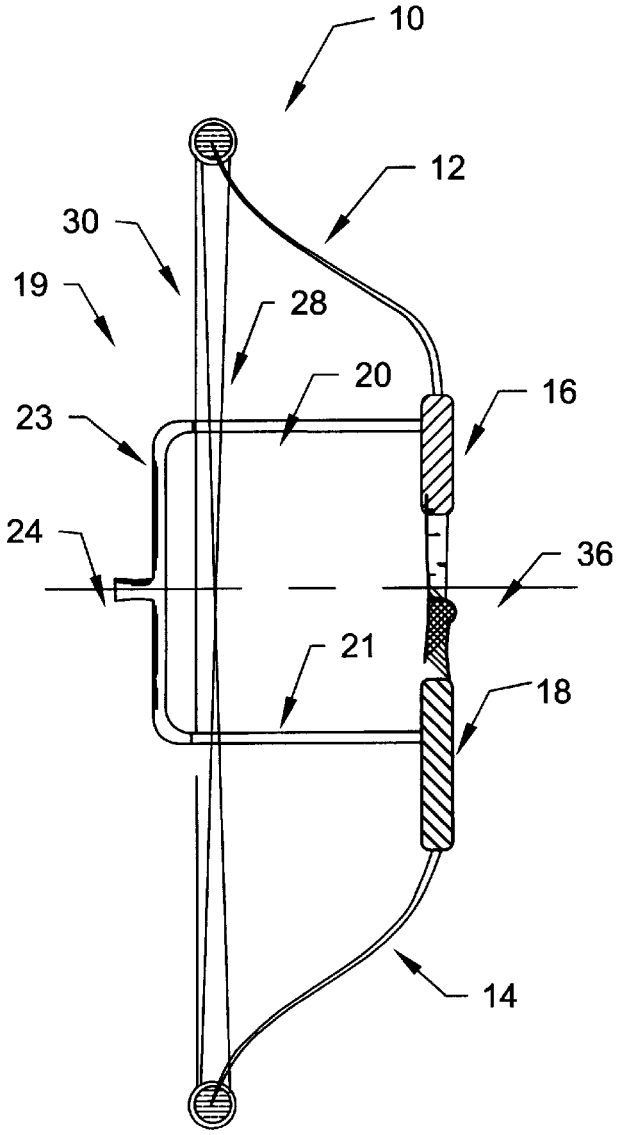
FIG. 1 shows a side view of a compound bow including the cross bar and push-head elements of the present invention.
Figure 2:
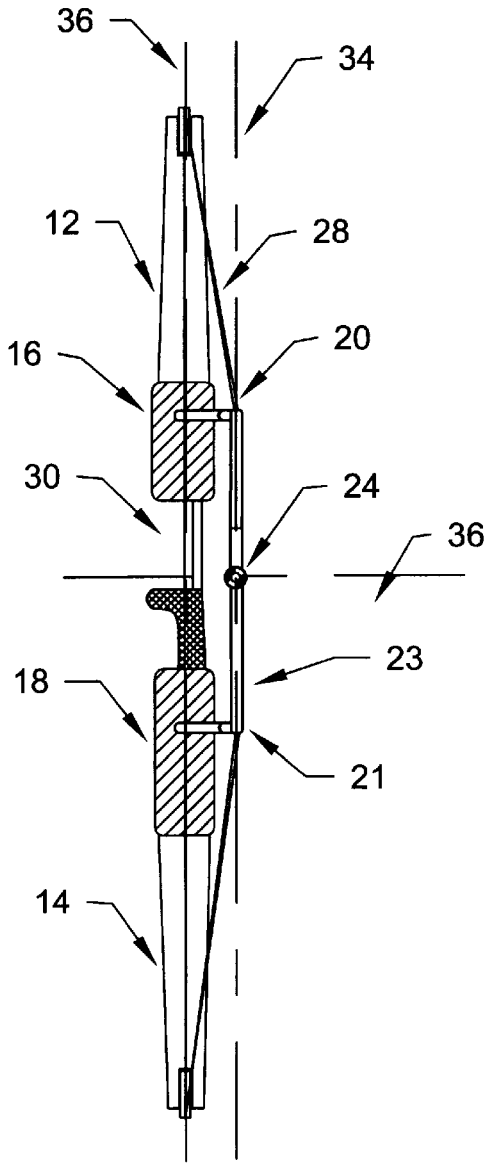
FIG. 2 shows a rear view of a compound bow including the cross bar and push-head elements of the present invention.
Figure 3:
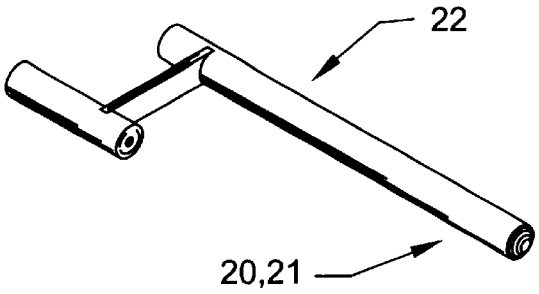
FIG. 3 shows a perspective view of the cable guards of the present invention.

Referring now to FIGS. 1–5, the support frame 19 is removably affixed to the bow 10, providing a stable point to which the gauntlet 39 engages. As shown in FIGS. 1–3, in a preferred embodiment, the support frame 19 comprises an upper and lower cable guard 20, 21, whereby the upper cable guard 20 is affixed to the upper extension 16 of the bow's 10 grip, and the lower cable guard 21 is affixed to the lower extension 18 of the bow's 10 grip. The upper and lower cable guards 20, 21 are affixed to the bow 10 forming an offset plane 34 parallel the bow plane 32, such that the cables 28 are positioned an offset distance from the bow plane 32.

Figure 5:
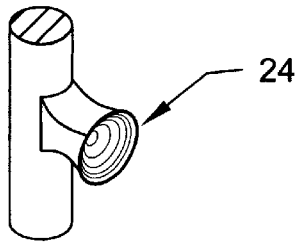
FIG. 5 shows a perspective view of the push-head of the present invention.
Figure 4:
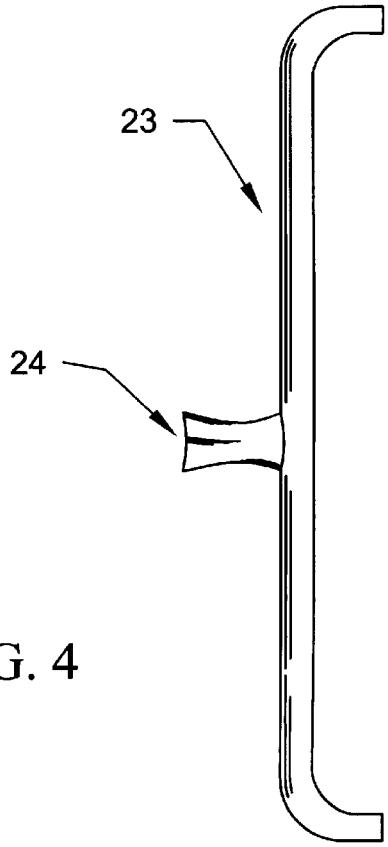
FIG. 4 shows a side view of the cross bar with the push-head of the present invention.

A cross bar 23 is affixed to the ends of the upper and lower cable guards 20, 21, whereby the cross bar 23 is perpendicular to the upper and lower cable guards 20, 21. As shown in FIGS. 4–5, the cross bar 23 comprises a push-head 24, whereby the push-head 24 is positioned substantially planar to the firing plane 36.

In an alternative embodiment, the distance between the offset plane 34 and the bow plane 32 is adjustable. The distance is increased by rotating the offset arm 22 of cable guards 20, 21 away from the bow plane 32, achieving a maximum distance when the cable guards 20, 21 are perpendicular to the bow plane 32. Similarly, the distance is decreased by rotating the offset arm 22 towards the bow plane 32, achieving a minimum distance when the cable guards 20, 21 are parallel to the bow plane 32.

Figure 8:
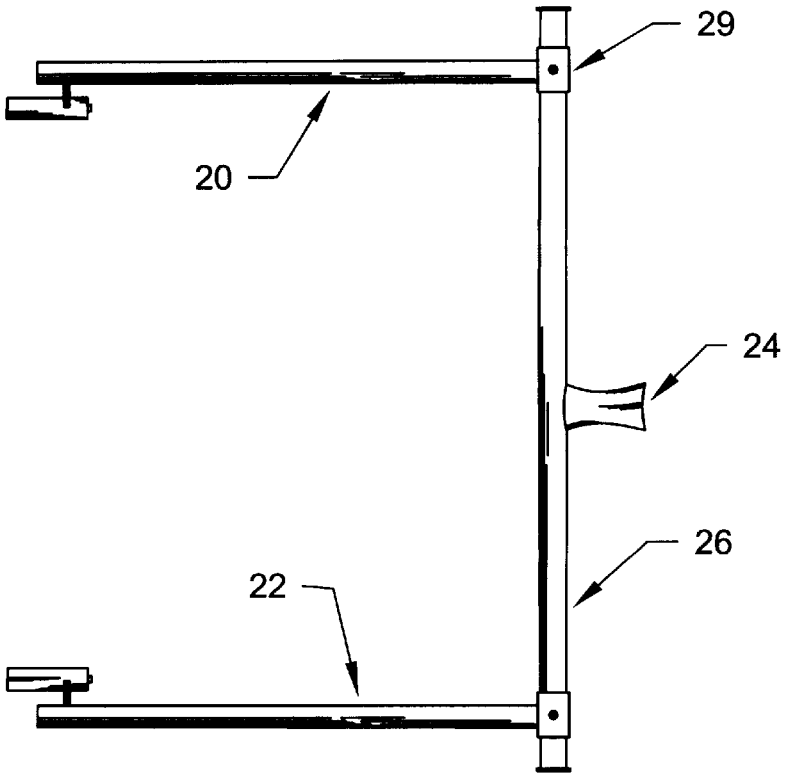
FIG. 8 shows an alternative embodiment of the side view of the cable guides and cross bar components of the present invention.
Figure 9:
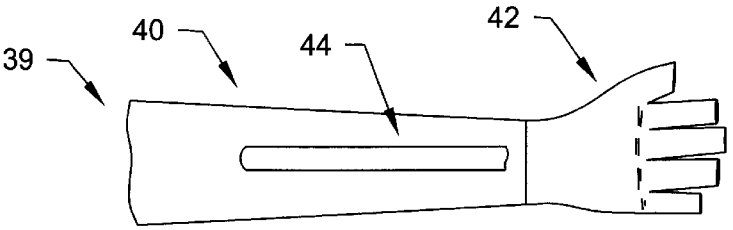
FIG. 9 shows a front side view of the forearm sleeve and glove of the present invention.
Figure 10:
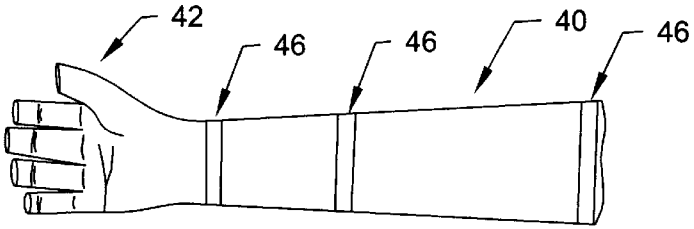
FIG. 10 shows a rear side view of the forearm sleeve and glove of the present invention.

In another embodiment, as shown in FIG. 8, the cross bar 23 is slidably connected to the ends of the cable guards 20, 21, such that the cable guards 20, 21 may be simultaneously rotated while maintaining the push-head 24 in a position substantially planar to the firing plane 36. The cross bar 24 is held in position by means of an allen screw 29 or other similar securing means.

Figure 6:
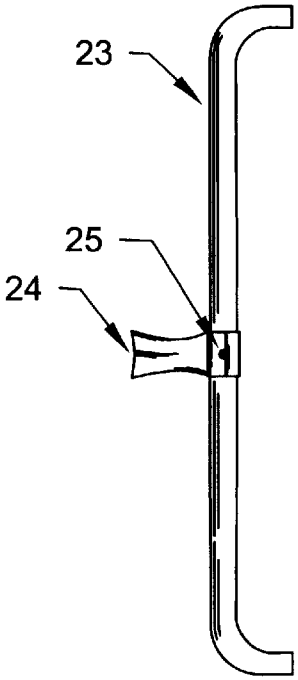
FIG. 6 shows an alternative embodiment of the side view of the cross bar with push-head components of the present invention.

In a further embodiment, as shown in FIG. 6, the push-head 24 is adjustable along the length of the cross bar 23. The push-head 24 is slidably affixed about the cross bar 23, being held in position with an allen screw 25 or other similar securing means.

Figure 7:
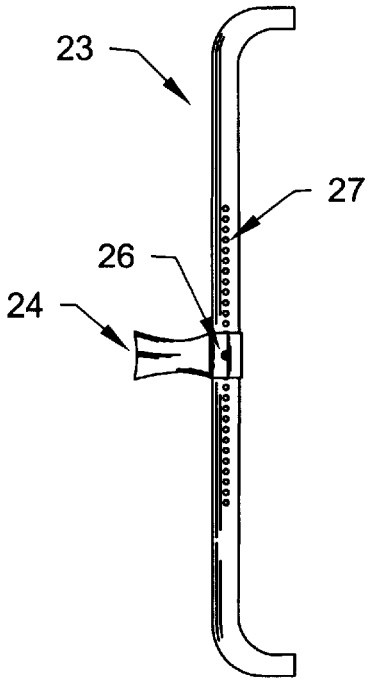
FIG. 7 shows an alternative embodiment of the side view of the cross bar with push-head components of the present invention.

Alternatively, as shown in FIG. 7, the cross bar 23 comprises a plurality of pin holes 27, with the push-head 24 having a corresponding pin hole 26. The push-head 24 is held in position with a cotter, or push pin, or other similar device.

In an alternative embodiment, the support frame 19 comprises a single cable guard 20. The push-head 24 is connected to the end of the offset 22, with the cable guard 20 being attached to the bow 10 such that the push-head 24 is in a position substantially planar to the firing plane 32.

Similarly, the bowstring draw assist mechanism of the present invention can be used with a conventional bow, whereby the support frame 19 is attached to the conventional bow in substantially the same manner as the compound bow.

Referring now to FIGS. 9-13, the gauntlet 39, which is worn by the archer, comprises a forearm sleeve 40 and a glove 42, whereby the forearm sleeve 40 is securely affixed to the glove 42. The forearm sleeve 40 comprises a cylinder pocket 44, which is positioned along the exterior surface and substantially traverses the longitudinal length of the forearm sleeve 40. The cylinder pocket 44 comprises an open front end and a substantially closed back end, whereby a compressed gas actuated cylinder 50 can be removably secured into the cylinder pocket 44, through the open front. The gauntlet 39 is secured to the archer by inserting the archer's hand into the glove 42 and securing the forearm sleeve 40 about the archer's forearm with the straps 46.

In an alternative embodiment, the gauntlet 39 is secured to the archer by inserting the archer's hand through the forearm sleeve 40 into the glove 42, whereby the forearm sleeve 40 surrounds the archer's forearm.

Figure 11:
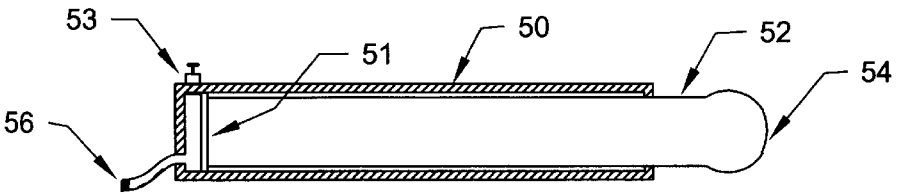
FIG. 11 shows a side view of the cylinder and piston in the retracted position.
Figure 12:
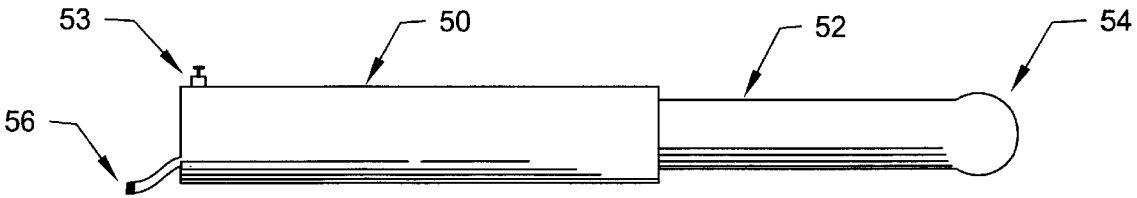
FIG. 12 shows a side view of the cylinder and piston in the extended position.

As shown in FIGS. 11-12, the compressed gas actuated cylinder 50 comprises a rod 52, with a piston 51 affixed to one end and a rod-head 54 affixed to the opposite end, whereby the piston 51 and rod 52 are slidably fitted into the cylinder 50. The piston 51 divides the interior space of the cylinder 50 into a first chamber and a second chamber, whereby the rod 52 slides through the second chamber. The cylinder 50 further comprises an air inlet 56, which is in communication with the first chamber, for the connection of a compressed gas delivery system 58, to provide compressed gas into the first chamber.

Figure 13:
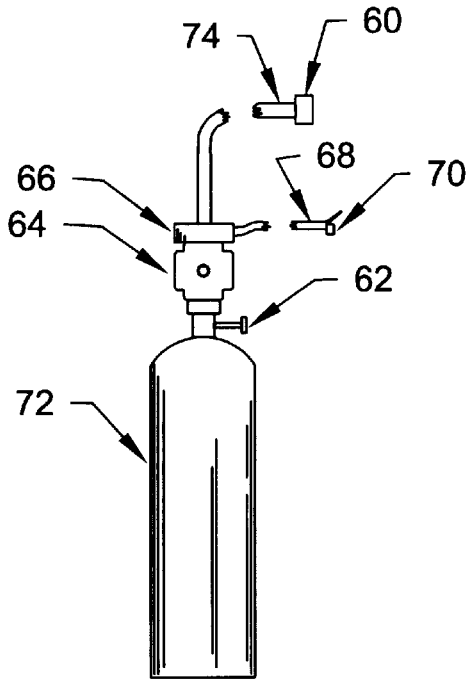
FIG. 13 shows the compressed gas delivery system of the present invention.

As shown in FIG. 13, the compressed gas delivery system 58 comprises a compressed gas tank 72 fitted with an adjustable regulator 64. The adjustable regulator 64 enables the gas pressure to be adjusted from about 10 psi–75 psi. The delivery system 58 further comprises a valve 66 and switch 70, whereby the switch 70 opens the valve 66, pressurizing the cylinder 50. The delivery system 58 is attached to the cylinder 50 at the air inlet 56 with an appropriately rated air hose 74 and connector 60.

Figure 14:
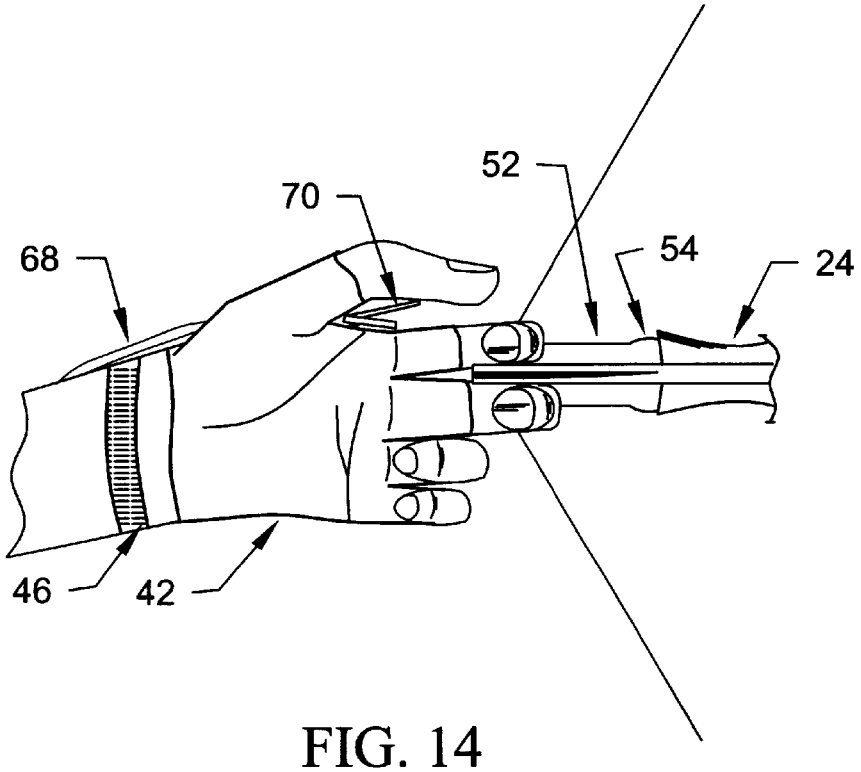
FIG. 14 shows the operation of the present invention.

In a method of use, as shown in FIG. 14, an archer grips the bow 10, while simultaneously nocking an arrow and positioning the rod-head 54 into the push-head 24. To draw back the bowstring 30, the archer pulls back on the bowstring 30, depressing the switch 70, thereby opening the valve 66. The compressed gas pressurizes the cylinder 50, extending the rod 52, and pushing the rod-head 54 into the push-head 24. When the bowstring 30 is in a fully extended position, the switch 70 is released, thereby closing the valve66.

In a preferred embodiment, the rod 52 remains in the extended position, assisting the archer in maintaining the bowstring 30 in the fully extended position while aiming. Upon release ofthe arrow, the cylinder 50 is vented by opening the pressure relief valve 53, thereby retracting the rod 52.

In an alternative embodiment, the valve 66 is a three-way valve. In a first position, the valve 66 is closed. In a second position, the valve 66 is open to the compressed gas, thereby pressurizing the cylinder 50 and extending the rod 52. In the third position, the valve 66 is open to the atmosphere, thereby venting the cylinder 50 and retracting the rod 52.

In an alternative embodiment, the drawstring assist mechanism is be used in conjunction with a draw and release device, whereby the archer utilizes the draw and release device to grip and release the bowstring 30.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A bowstring draw assist mechanism comprising;

a) a support frame, wherein said support frame is affixed to a bow;

b) a gauntlet, wherein said gauntlet is worn by an archer; and c) a gas actuated cylinder, wherein said gas actuated cylinder is removably secured to said gauntlet, and wherein said gas actuated cylinder engages said support frame.

2. A bowstring draw assist mechanism according to claim 1, wherein said support frame comprises at least one cable guard.

3. A bowstring draw assist mechanism according to claim 2, wherein said support frame further comprises;

a) an upper cable guard and a lower cable guard, wherein said upper and said lower cable guards are affixed to said bow; and b) a cross bar, wherein said cross bar is affixed to said upper and said lower cable guards, and said cross bar comprises a push-head.

4. A bowstring draw assist mechanism according to claim 3, wherein said upper and said lower cable guards are rotatably attached to said bow.

5. A bowstring draw assist mechanism according to claim 3, wherein said cross bar is slidably attached to said upper and said lower cable guards.

6. A bowstring draw assist mechanism according to claim 3, wherein said push-head is slidably attached to said cross bar.

7. A bowstring draw assist mechanism according to claim 1, wherein said gauntlet comprises a glove and a forearm sleeve, wherein said glove is affixed to said forearm sleeve.

8. A bowstring draw assist mechanism according to claim 7, wherein said gauntlet further comprises a cylinder pocket affixed to an outer surface of said forearm sleeve.

9. A bowstring draw assist mechanism according to claim 7, wherein said forearm sleeve comprises at least one strap, such that said at least one strap secures said forearm sleeve to a forearm of the archer.

10. A bowstring draw assist mechanism according to claim 1, wherein said gas actuated cylinder comprises a rod, wherein a piston is affixed to a first end of said rod and a rod-head is affixed to an opposite end of said rod, wherein said piston and said rod are slidably positioned into said gas actuated cylinder.

11. A bowstring draw assist mechanism according to claim 10, wherein said cylinder further comprises a pressure relief valve.

12. A bowstring draw assist mechanism according to claim 10, wherein said gas actuated cylinder further comprises a compressed gas delivery system.

13. A bowstring draw assist mechanism according to claim 12, wherein said compressed gas delivery system comprises a compressed gas tank, a regulator, a valve, and a valve switch, wherein said regulator is connected to said compressed gas tank, said valve is connected to said regulator, and said valve switch is connected to said valve, such that said valve switch opens and closes said valve.

14. A bowstring draw assist mechanism according to claim 13, wherein said valve switch is attached to said gauntlet.

15. A bowstring draw assist mechanism according to claim 13, wherein said regulator is adjustable.

16. A bowstring draw assist mechanism according to claim 15 wherein said regulation is adjustable between about 10 psi–75 psi.

17. A bowstring draw assist mechanism according to claim 13, wherein said valve is a three-way valve.

18. A bowstring draw assist mechanism according to claim 13, wherein said compressed gas delivery system further comprises a pressure gauge, wherein said pressure gauge is attached to said compressed gas tank.

19. A method of drawing a bowstring using a bowstring draw assist mechanism, wherein said bowstring draw assist mechanism comprises; a support frame affixed to a bow, a gauntlet, wherein said gauntlet is worn by an archer, and a gas actuated cylinder removably secured to said gauntlet, wherein said gas actuated cylinder engages said support frame, comprising the following steps:

a) gripping said bow;

b) nocking an arrow onto said bow;

c) engaging said gas actuated cylinder with said support frame;

d) pressurizing said gas actuated cylinder; and e) drawing back said arrow into a firing position.

* * * * *